United States Patent [19]

McTamaney et al.

[11] Patent Number: 4,551,730

[45] Date of Patent: Nov. 5, 1985

[54] METHOD AND APPARATUS FOR ENTERING CONTROL POINTS RELATIVE TO A DYNAGRAPH OF A WELL PUMPING UNIT

[75] Inventors: Louis S. McTamaney, Cupertino, Calif.; Gary W. Bisbee, The Woodlands, Tex.; Robert W. Kettlety; James L. Konsevich, both of San Jose, Calif.

[73] Assignee: FMC Corporation, Chicago, Ill.

[21] Appl. No.: 470,017

[22] Filed: Apr. 18, 1983

[51] Int. Cl.[4] ..... G01D 9/00; E21B 47/00

[52] U.S. Cl. ..... 346/33 WL; 73/151

[58] Field of Search ..... 346/33 WL; 73/151

[56] References Cited

U.S. PATENT DOCUMENTS

| | | | |
|---|---|---|---|
| 2,107,151 | 2/1938 | Higginson | 346/33 WL |
| 3,951,209 | 4/1976 | Gibbs | 73/151 X |
| 4,043,191 | 8/1977 | Mills | 73/151 |
| 4,143,546 | 3/1979 | Wiener | 73/151 |
| 4,208,665 | 6/1980 | Mills | 346/33 WL |
| 4,307,395 | 12/1981 | Standish | 346/33 WL X |
| 4,363,605 | 12/1982 | Mills | 73/151 X |

*Primary Examiner*—George H. Miller, Jr.

*Attorney, Agent, or Firm*—L. B. Guernsey; H. M. Stanley; R. B. Megley

[57] ABSTRACT

Method and apparatus for entering control points relative to a dynagraph of a well pumping unit using the position of a beam and a pen holder of an XY plotter. The beam and/or the pen holder is physically moved to a desired location and an "enter" button is pressed to enter a value corresponding to an X or a Y position and another button is used to enter the other corresponding position value. The entered point is used to control operation of the well.

3 Claims, 16 Drawing Figures

X-Y PLOTTER

MESSAGE FLOW DIAGRAM X-Y DATA ENTRY

| | STATE 1 | STATE 2 | STATE 3 |
|---|---|---|---|
| MESSAGE 1 | PROCESS A | PROCESS D | PROCESS G |
| MESSAGE 2 | PROCESS B | PROCESS E | PROCESS H |
| MESSAGE 3 | PROCESS C | PROCESS F | PROCESS I |

STATE MACHINE SYMBOLOGY

MESSAGE SWITCHED OPERATING SYSTEM

STATE MACHINE SCHEDULER

DATA ACQUISITION

SETUP DISPLAY HANDLER STATE DIAGRAM

PARAMETER INPUT SELECTOR STATE DIAGRAM

A TO D HANDLER STATE DIAGRAM

KEYBOARD HANDLER STATE DIAGRAM

METHOD AND APPARATUS FOR ENTERING CONTROL POINTS RELATIVE TO A DYNAGRAPH OF A WELL PUMPING UNIT

BACKGROUND OF THE INVENTION

The present invention relates to methods and apparatus for monitoring the operation of sucker-rod well pumping units, and more particularly to methods and apparatus for entering control points relative to the dynagraph of a well pumping unit.

Sucker-rod type pumping units are widely used in the petroleum industry in order to recover fluid from wells extending into subterranean formations. Such units include a sucker-rod string which extends into the well and means at the surface for an up and down movement of the rod string in order to operate a downhole pump. Typical of such units are the so called "beam-type" pumping units having the sucker-rod string suspended at the surface of the well from a structure consisting of a Samson post and a walking beam pivotally mounted on the Samson post. In one type of pumping unit the sucker-rod string is connected at one end of the walking beam and the other end of the walking beam is connected to a prime mover such as a motor through a suitable crank and pitman connection. In this arrangement the walking beam and the sucker-rod string are driven in a reciprocal mode by the prime mover.

A variety of malfunctions such as worn pumps, broken sucker-rods, split tubing, and stuck pump valves can interrupt the pumping of fluid from a well. Such malfunctions can be caused by normal wear and tear on the equipment, by the nature of the fluid being pumped or they could be caused by abnormal pumping conditions.

One abnormal pumping condition which is fairly common is known as "fluid pound". Fluid pound occurs when the well is pumped-off, i.e., when fluid is withdrawn from the well at a rate greater than the rate at which fluid enters the well from the formation. When this occurs, the working well of the downhole pump is only partially filled during an upstroke of the plunger and on the down stroke the plunger strikes or "pounds" the fluid in the working barrel causing severe jarring of the entire pumping unit. This increases the amount of energy used in pumping and causes damage to the rod string and to the surface equipment and may lead to failure of the pumping unit.

Controllers are placed on the well to detect this fluid pound condition in sucker-rod pumped wells and to turn off the pump motor. Many controllers require entry of one or more control points relative to the pump dynagraph (load vs. position plot) in order to accomplish this control task.

SUMMARY OF THE INVENTION

The present invention provides new and improved methods and apparatus for entering control points relative to the dynagraph of a well pumping unit having a sucker-rod string and a power unit to reciprocate the rod string to produce fluid from a well. An XY recorder having a servo controlled beam and pen to position itself to any X and Y coordinates specified at the recorder input is used to obtain the dynagraphs. The actual position of the beam (X) and pen (Y) is available as an output, since it is needed by the servo system to position itself. If the servo drive is turned off, and if the beam and pen are moved manually, the X and Y position outputs reflect the actual position of the beam (X) and pen (Y). These can then be used as a control point input to a control system. If the control system is digital in nature, e.g., a micro-computer based system, then these analog X-Y plotter outputs can be converted to digital format via an A to D converter.

When coupled with a set of function switches and an enter switch, a multiplicity of such X-Y inputs can easily be entered into a control system.

DESCRIPTION OF THE PREFFERED EMBODIMENT

Figure 1:
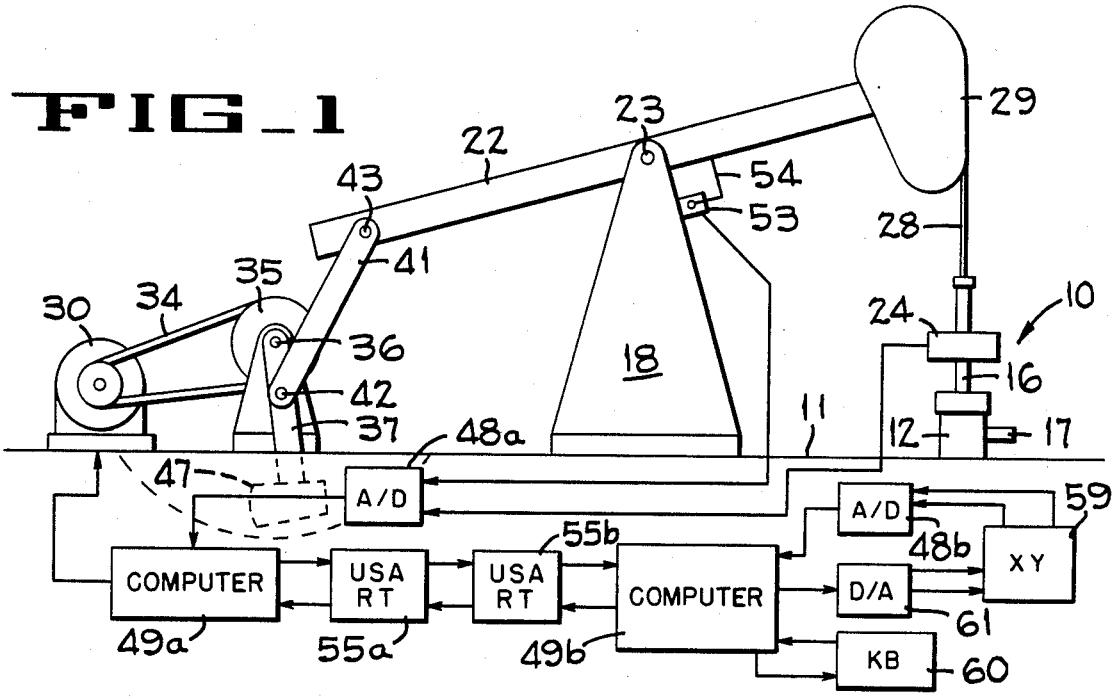
FIG. 1 is a diagrammatic illustration of a well equipped with a sucker-rod type pumping unit.

Referring to FIG. 1, there is illustrated a wellhead 10 of a well which extends from the earth's surface 11 into a subsurface well producing formation (not shown). The wellhead comprises the upper portions of a casing string 12 with a sucker-rod string 16 extending downward into a down hole pump (not shown) which moves liquid to the surface where it passes into a flow line 17. The sucker-rod string 16 is suspended in the well from a support unit consisting of a support post 18 and a walking beam 22 which is pivotally mounted on the support post by a pin connection 23. A load cell 24 is connected between the upper end of the sucker-rod string 16 and the lower end of a cable section 28. The cable section 28 is connected to the walking beam 22 by means of a horsehead 29.

The walking beam 22 is reciprocated by a prime mover such as an electric motor 30. The prime mover drives the walking beam through a drive system which includes a drive belt 34, crank 35, crank shaft 36, crank arm 37, and a pitman 41 which is pivotally connected between the crank arm and the walking beam by means of pin connections 42, 43. The outer end of the crank arm 37 is provided with a counterweight 47 which balances a portion of the load on the sucker-rod string in order to provide a more constant load on the prime mover.

The load cell 24 provides a DC output signal which is proportional to the load on the sucker-rod string 16, and an analog-to-digital converter 48*a* provides a corresponding digital signal to a computer 49*a*. A position measuring means or transducer 53 includes an actuating arm 54 for measuring the vertical position of the sucker-rod string 16 by providing a voltage which is proportional to the angle of the walking beam 22 and thus is proportional to the position of the rod string 16. The analog-to-digital converter 48*a* also converts the signal from the transducer 53 into a digital signal which is used by the computer 49*a*. Signals are transferred from the computer 49*a* to a computer 49*b* by a pair of universal synchronous asynchronous receiver transmitters (USARTs) 55*a*, 55*b* for controlling the operation of an XY plotter 59. Instructions from a keyboard and display unit 60 and output signals from the load cell 24 and position transducer 53 are used by the XY plotter to provide a visual plot of the characteristics of the particular well which the rod string operates. The plotter 59 can be used for observing operation of the well and for setting up the equipment to monitor the well. After setup is completed the plotter and its associated circuitry can be disconnected. Analog beam and pen position signals from the XY plotter 59 are converted into digital signals by an analog-to-digital converter 48*b* for use by the computer 49*b* digital signals from the computer 49*b* are converted into analog signals by a digital-to-analog converter 61 for use by the plotter.

Figure 2:
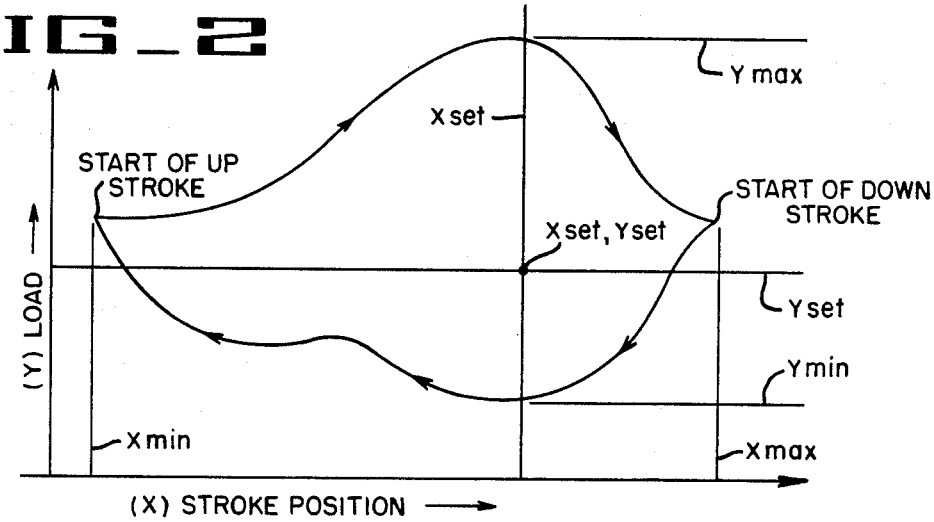
FIG. 2 is a plot of the position vs. load of the sucker-rod of the pump for one cycle of normal operation and showing a reference point in the plot.
Figure 4:
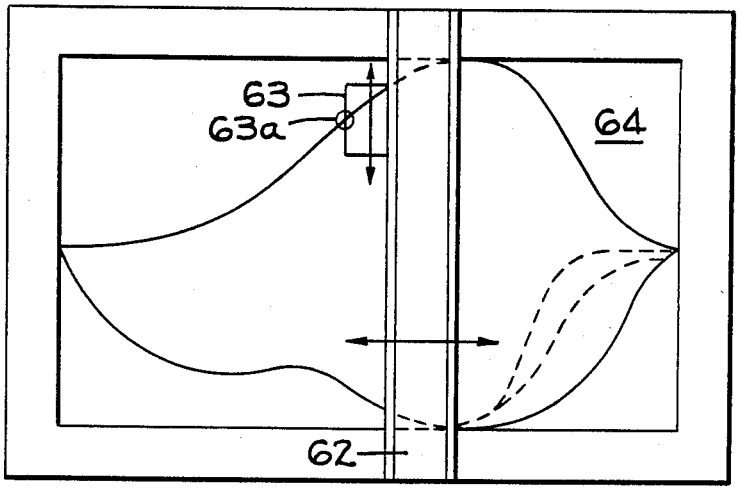
FIG. 4 illustrates a typical XY plotter showing beam and pen.

The XY plotter 59 (FIG. 4) includes a beam 62 which moves horizontally in response to rod position (X) signals, a pen holder 63 which moves vertically in response to rod load (Y) signals, and a pen 63*a* which traces a dynagraph on a sheet of paper 64 in response to the X and Y signals. A plot of the position versus load of the rod string 16 (FIG. 1) for a typical cycle of the rod string when the well is filled with fluid is disclosed in FIG. 2. It can be seen that as the rod string moves on the upstroke from the Xmin position to the Xmax position, the load on the string increases to a maximum value and then returns to approximately the initial value. Of more importance is the variation in the load as the rod string moves downward with the load decreasing to a minimum value at a fairly rapid rate and then moving upward to approximately the original value at the Xmin position.

Figure 3:
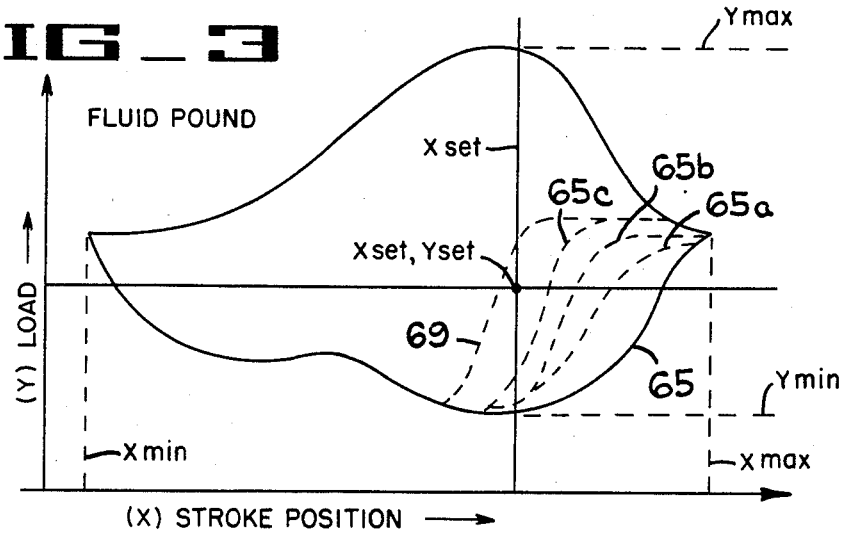
FIG. 3 is a plot of position vs. load of the sucker-rod as the well progresses into fluid pound.

As the well approaches pump-off (FIG. 3), the load on the rod string changes more rapidly as the rod string moves in a downward direction. When the fluid in the well drops, a pump plunger in the pump falls and strikes the surface of the fluid in the well producing a "fluid pound" which can damage the rod string and other parts of the pumping system. As the fluid level in the well decreases the pump plunger progressively moves a greater distance on the downstroke before contacting the surface of the fluid in the well causing the plotted load curve to progressively change from the full well curve 65 to the dotted curves 65*a*–69 with the curve moving progressively toward the left as the fluid in the well drops lower. This moving trend can be observed and the pump shut down to prevent damage to the equipment.

A method for detecting pump-off uses the apparatus of FIG. 1 to select a set point (Xset, Yset) (FIGS. 2, 3) having a value determined by the characteristics of each individual well and set relative to the well dynagraph. The computer 49*a* (FIG. 1) compares the fluid pound curves 65*a*–69 with the position of the set point and shuts down the motor 30 when the fluid pound curve moves to the left of the set point shown in FIG. 3.

A human operator can use the keyboard 60 input to the computer 49*b* (FIG. 1) to enter an X percentage value and a Y percentage value into the computer 49*b* which transfers these values to the computer 49*a* to be used as control points in order to detect a fluid pound condition. However, entry of such a control point or other similar control point by means of numbers on a keyboard, such as percent of full scale or some absolute value expressed in engineering units such as pounds and inches require that the operator first perform certain calculations and/or conversions. This is inconvenient and may lead to an insertion of erroneous values into the system, especially when the human operator is not skilled in the use of engineering units. The human operator is familiar with dynagraphs as he will have previously plotted a dynagraph of the well, indicating its behavior as it enters the fluid-pound condition (FIG. 3) and the dynagraph is secured to the plotter table. The computer 49*b* has moved the beam and pen to a home position and has turned off the X and Y servos, leaving the beam and pen available for manual positioning. The operator pushes the desired function switch (Xset entry or Yset entry for example) on the keyboard 60 and moves the beam or pen holder to the position he desires for that function. He then pushes the enter switch, causing the computer 49*b* to transmit this value to computer 49*a*, thereby permitting computer 49*a* to use the current beam or pen holder position as the control point for that function. In practice, a digital display can also be provided to indicate the actual values, scaled to engineering units of the pen holder position and beam position. If two such displays were used, the operator could, for example, manually move the beam and pen to trace over the dynagraph and obtain a feedback of the actual readings for any point on the dynagraph.

In actual usage the functions could be such as:

(A) Stroke cut point for a set point detector (B) Load cut point for a set point detector (C) X and/or Y window boundaries for any detector.

Figure 5:
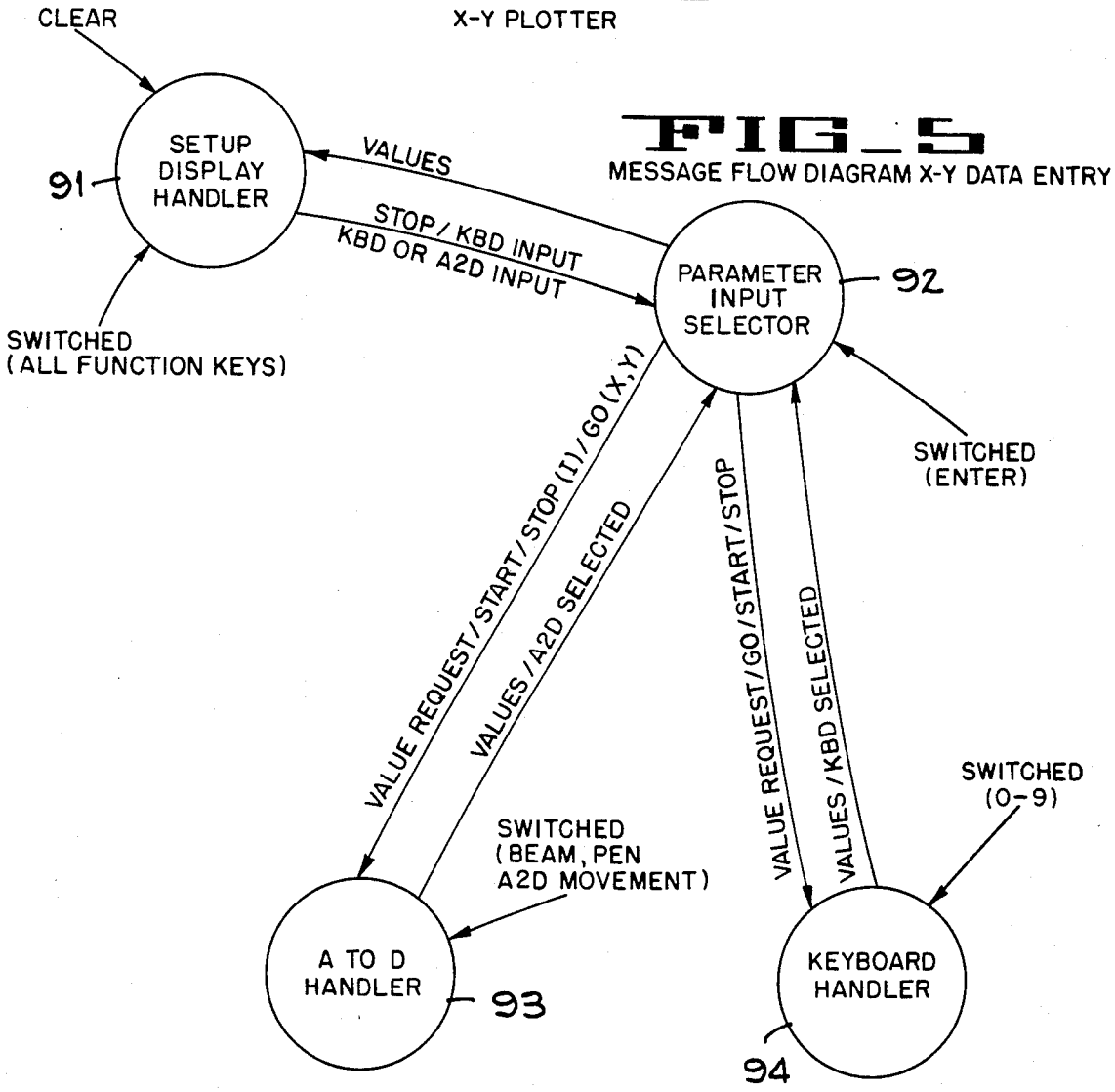
FIG. 5 is a message flow diagram for a XY data entry of the present invention.
Figure 6A:
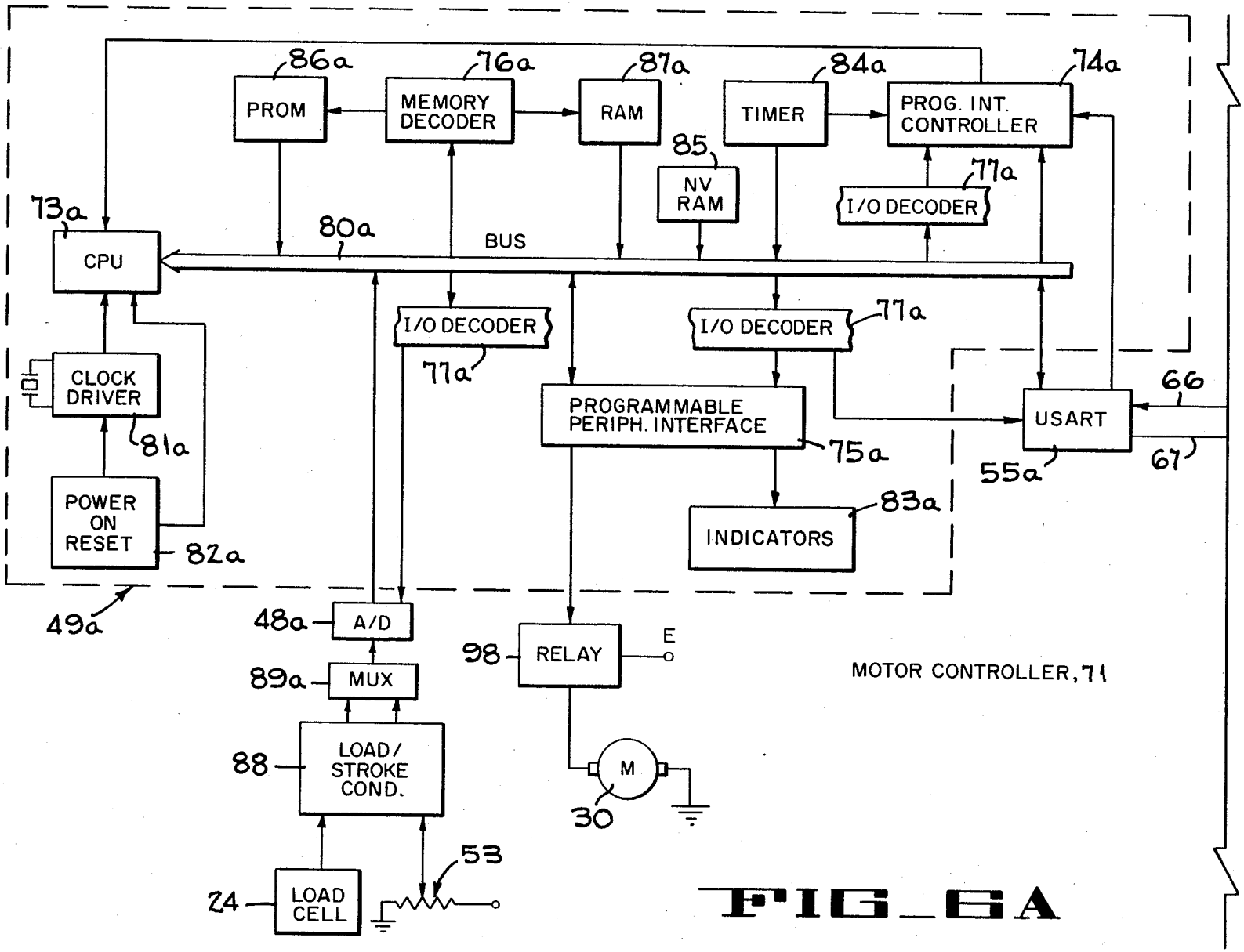
FIGS. 6A, 6B comprise computer circuitry which can be used in the apparatus of FIG. 1.
Figure 6B:
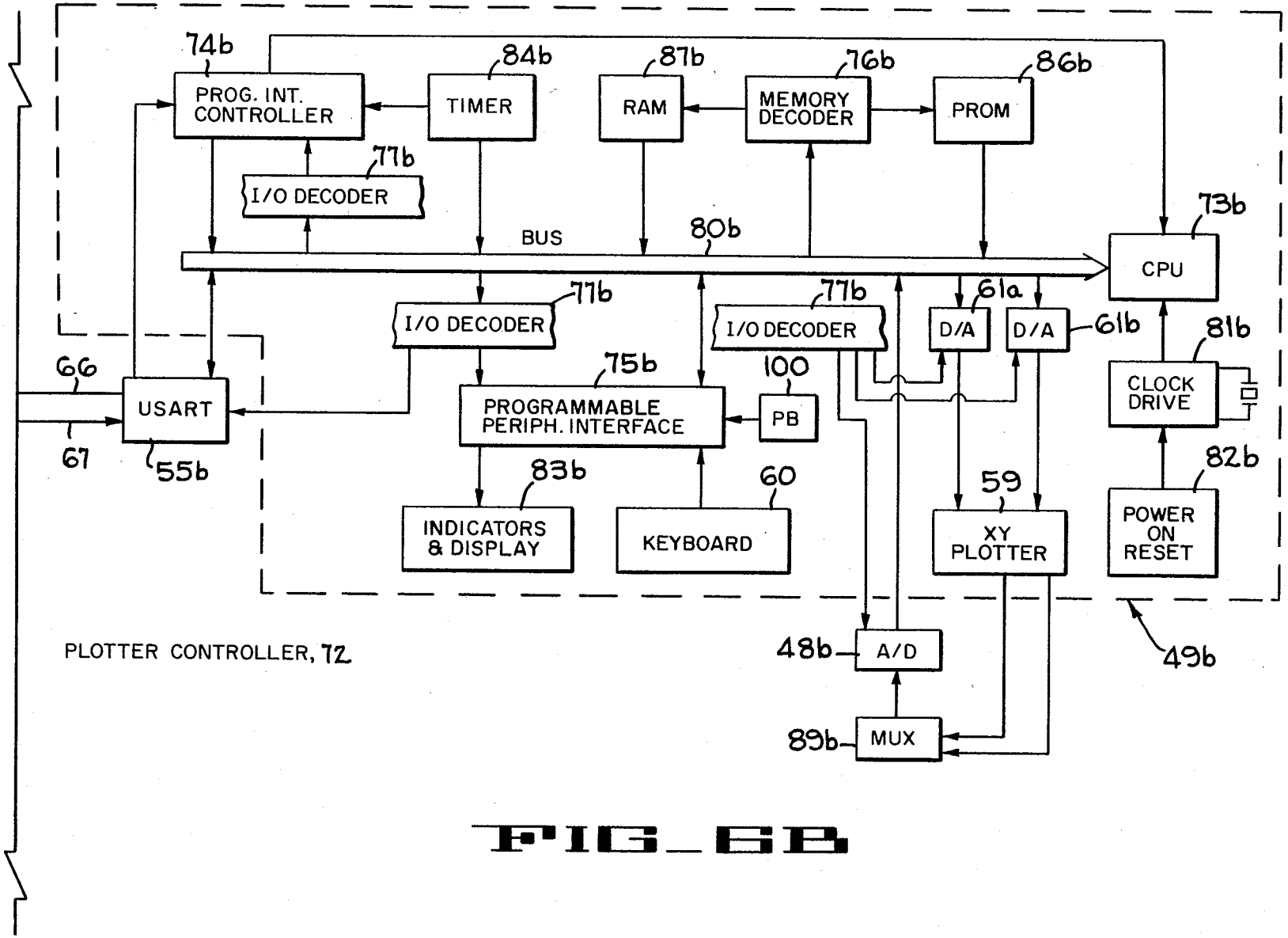

Details of a method and apparatus for entering control points relative to the dynagraph of a well pumping unit are disclosed in FIGS. 5–6A and 6B. When FIGS. 6A, 6B are placed side-by-side with leads from the right side of sheet 6A extending to corresponding leads from the left side of sheet 6B the two sheets comprise a block diagram of an embodiment of the computers 49*a*, 49*b* (FIG. 1).

The portion of the computer system disclosed in FIG. 6A comprises a motor controller 71 for receiving signals from the load cell 24 and from transducer 53 and for using these signals to determine the sequence for controlling the motor 30. The computer 49*b* disclosed in FIG. 6B comprises a plotter controller 72 for using the load cell and transducer signals transmitted from computer 49*a* to operate the XY plotter 59. Signals are interchanged between the motor controller 71 and the plotter controller 72 over the pair of interconnecting wires 66, 67.

Each of the controllers 71, 72 includes a central processor 73*a*, 73*b*, a programmable interrupt controller 74*a*, 74*b*, a programmable peripheral interface 75*a*, 75*b* and a memory decoder 76*a*, 76*b* connected for the interchange of information and instructions over a system bus 80*a*, 80*b*. A central processor 73*a*, 73*b* which can be used in the present invention is the model 8088 manufactured by Intel Corporation, Santa Clara, Calif. A programmable peripheral interface 75*a*, 75*b* which can be used is the model 8255A and a programmable interrupt controller 74*a*, 74*b* which can be used is the model 8259A both manufactured by Intel Corporation. An input/output decoder 77*a*, 77*b* decodes address signals for selectively enabling the peripheral interfaces 74*a*, 75*b* to send and receive information from the system bus 80*a*, 80*b*.

Clock pulses for driving the central processors 73*a*, 73*b* are provided by a pair of clock drivers 81*a*, 81*b* which are initialized by a pair of "power on reset" generators 82*a*, 82*b*. The generator 82*a* also includes a power fail circuit to warn that power to the controller is failing. A clock driver 81*a*, 81*b* which can be used in the present invention is the model 8284A manufactured by Intel Corporation. A pair of indicating devices 83*a*, 83*b* provide visual display of information from the peripheral interfaces 75*a*, 75*b*. The indicating device 83*a* also includes a plurality of switches for entering information into the motor controller. A pair of timers 84*a*, 84*b* provide timing signals to operate the controllers 74*a*, 74*b* and information is transferred between the motor controller 71 and the plotter controller 72 by the pair of universal synchronous asynchronous receiver transmitters (USARTs) 55*a*, 55*b*. One such USART which can be used in the present invention is the model 8251A manufactured by Intel Corporation. Programs for operating the motor controller 71 and the plotter controller 72 are stored in a PROM 86*a*, 86*b* and data for use in the system is stored in a RAM 87*a*, 87*b*. Data to be retained during a power failure can be stored in a nonvolatile RAM 85. One such RAM which can be used in the present invention is the model IXD2212 manufactured by XICOR, Inc., Milpitas, Calif. A load/-stroke conditioner 88 (FIG. 6A) amplifies and filters signals transmitted from the load cell 24 and the transducer 53 and sends the smoothed signals to the bus 80*a* through a multiplexer 89*a* and the analog-to-digital converter 48*a*. A pair of digital-to-analog converters 61*a*, 61*b* (FIG. 8B) provide analog signals to operate the XY plotter 59 in response to digital signals on the system bus 80*b*. A multiplexer 89*b* and the analog-to-digital converter 48*b* provide digital signals which correspond to the X and Y positions of the plotter 59. An analog-to-digital converter which can be used is the model AD5-74A manufactured by Analog Devices.

The general operation of the method for entering control points relative to the dynagraph of a well pumping unit using the apparatus of the present invention have been described in connection with FIGS. 1–4. A detailed description of the entry of the control points using the plotter controller 72 will be described in connection with FIGS. 5–15 which provide background of the use of software state machines and of their use in operating the apparatus of FIGS. 1, 4, 6A and 6B and provides details of the operation of a computer program in carrying out various operations performed by the computer of FIGS. 6A, 6B.

The program of the present computer is supported by a real time operating system having various routines that are not applications oriented and that are designed specifically to support programs designed with the state machine concept, that is, a state, input driven program. Some of the routines are sub-routines while others form a module that creates a simple real-time environment under which software state machines can operate. The operating system provides equipment in which a collection of software state machines can operate.

Figures 7, 8:
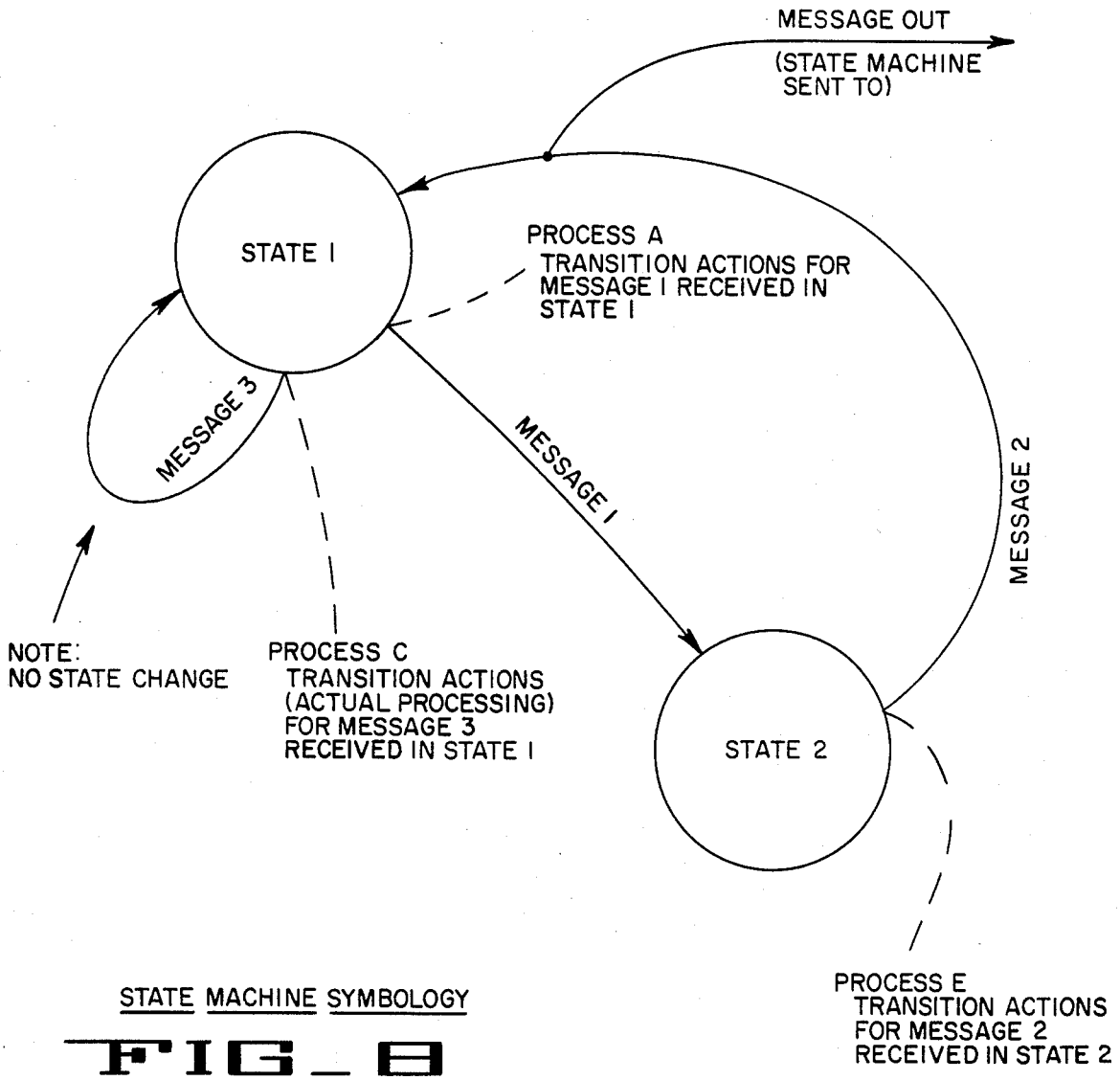
FIG. 7 is a matrix diagram illustrating the operation of software state machines used in the present invention.
FIG. 8 is a diagram illustrating symbology of a typical software state machine used in the present invention.

A software state machine is a process that is executed on the digital computer each time that a message is sent to the state machine. The process does not execute in exactly the same way each time that a like message is sent to it because the processing to be done for any message depends on the machine's "state", i.e., its memory of all prior processing that it has done in response to the previous messages. The state can be any length, from eight binary digits to several thousand binary digits depending upon the complexity of a given machine. Given the state of the machine and the current message, the machine will do a given set of processing which is totally predictable. A machine can be represented as a matrix of processes, indexed by a state and a message as shown in FIG. 7. For example, if the state machine of FIG. 7 receives message number one in state one, then process A will be done. If process A were to cause the state to be changed to state 2 then a second message number one, coming right after the first message would cause process D to occur which could cause the machine to change to state 3. It is not necessary that a process cause the state to change, although it may do so in many cases.

A software state machine, upon completing its process defined by the state and by the message returns control to the program that called it, the state machine scheduler which will be described below. During the given process, the machine is not interrupted in order to give processing time to another machine of the same system. Thus, processing time appointment between a given machine and any of its contemporaries in the system is on a message-by-message basis, and such an environment is called a message switched operating system (MSOS). None of the machine's processes are ever suspended for the processes of another machine. For example, if message three comes in state one, process C will begin and end before another state machine can have the central processing unit (CPU) 73*a* (FIG. 6A) to respond to its next message in its given state.

Certain things can cause a state machine process to "suspend". For example, an asynchronous interrupt can be registered and processed. A requirement of the operating environment is that such hardware events are turned into software messages to be processed in order by the responsible state machine. Only that processing that must be done at the exact instant of the interrupt is done and then the interrupt service process will cause a software flag to be raised, ending the interrupt process. When the operating system notes an asynchronous flag (semaphore), it generates the needed software message to be sent to the state machine that will carry out the non-time-critical segment of the interrupt processing. An example of such a process is data collection at precisely timed intervals. When the timer interrupt signals that data must be collected, it is read in the required manner dependent on the type of the data, queued in a storage area for processing at a later time, and a flag is raised. When this raised flag is noted by the operating system, a software message is generated, the data is stored and the state machine that is responsible for the processing of this data receives the message at a later time.

A state machine is not given access to the processor by the operating system on a regularly timed basis but is connected to the processor only in order for it to process a message. Whenever the processing of a message is completed the state machine must insure that it will get another message at some point in the future. This is done in the following ways:

(1) Another machine sends a message for synchronizing purposes.
(2) A time period elapses signaled by a timer message.
(3) Real-time data becomes available from some queue.
(4) An input which is being polled, achieves the desired state, and initiates the software message.
(5) An interrupt is sensed and a software message is sent to inform the state machine about this event.

The only time that a machine cannot take care of itself is prior to receiving its first message, so the operating system takes the responsibility of initiating the system by sending to all of the software state machines, functioning therein, an initializing message referred to herein as a "power on"message. No matter what the state of the machine it will respond with a predetermined given process when this message is received independent of the state of the machine.

A convenient means of illustrating the operation of a software state machine is shown in the state machine symbology of FIG. 8 using the messages of FIG. 7 to do some of the processes and to move into some of the states shown in FIG. 7. If we assume the machine (FIG. 8) to be initially in state one, the receipt of message one causes process A to be performed as the transition action for message one received in state one and also causes the machine to move into state two. In state two the receipt of message two causes process E, causes a message to be sent out to another state machine and moves this state machine back into state one. In state one the receipt of message three causes process C as the transition action for receiving message three in state one but does not cause any change in the state of the machine. Some of the other states and processes shown in FIG. 7 are not repeated in FIG. 8 in order to simplify the drawing.

Figure 9:
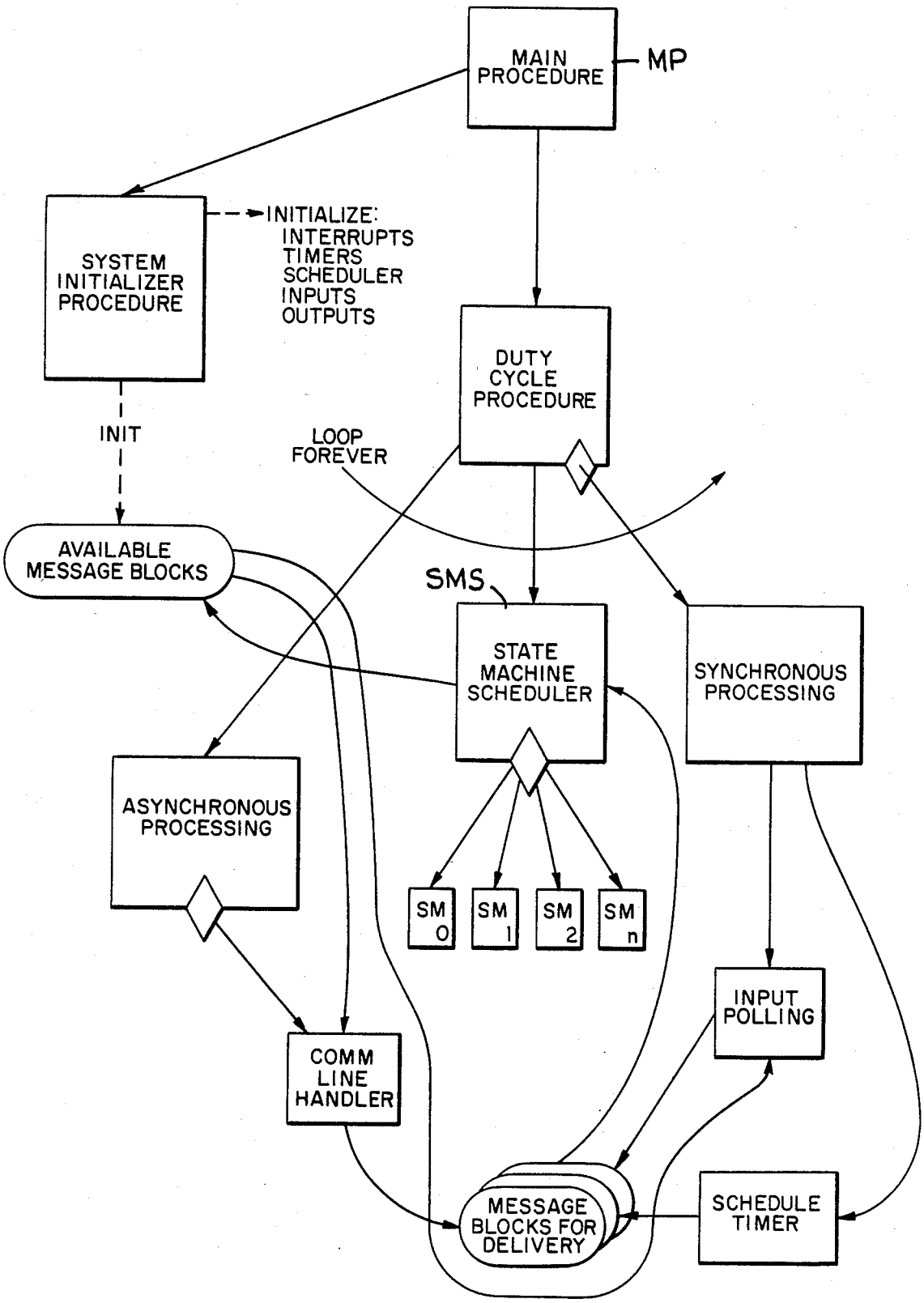
FIG. 9 illustrates a message switched software operating system of the present invention.
Figure 11:
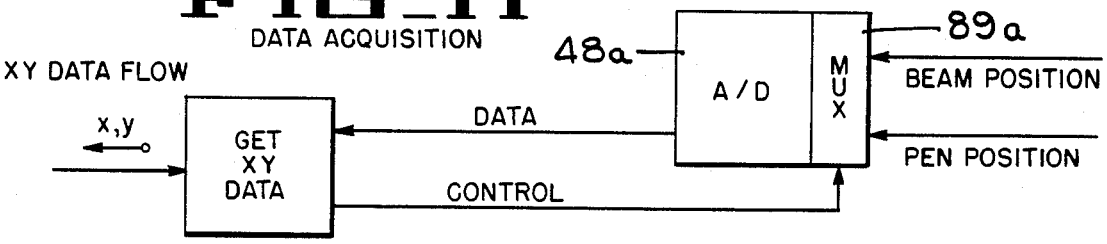
FIG. 11 illustrates the flow of data through the operating system of the present invention.

A message switched operating system of the type shown in FIG. 9 includes a main procedure which provides signals to initialize the system through a system initializing procedure and includes the initialization of various interrupts, timers, the scheduler, inputs, data acquisition, the nonvolatile RAMs, the math utility and outputs as well as initializing the available message blocks so that all dynamic memory is put into an available space queue for storing data. The procedure then calls the duty cycle procedure which sequentially calls the asynchronous processing, state machine scheduler and synchronous processing over and over again. All interrupt programs communicate with the duty cycle program by way of semaphores. The duty cycle program runs indefinitely with a state machine message delivery, an asynchronous operation and all synchronous operations timed by the real-time clock for each cycle of the loop. Asynchronous operations that can occur are communication line interrupts to move characters in and out of the system. In the asynchronous operation significant events occurring cause an available message block to be secured and turned into a message to be delivered to whatever state machine is charged with processing the particular interrupt. Details of the data flow are shown in FIG. 11. Signals from the plotter pen holder position and beam position are acquired by the GET XY data procedure and are transferred into RAM **87*b* (FIG. 6B**) whenever requested.

The synchronous processing performs hardware input polling, timer aging and signal delivery. When an input, requested for polling by any state machine, gets to the desired state such as an off condition, an on condition, above a level or below a level, etc. an available message block is sent as a message to the requesting machine indicating that a given input is in the desired state. The input will no longer be polled until another request is made.

The timer process is slightly different in that the timer queue is made up of message blocks serving as receptacles for the machine requesting the marking of the passage of time and the time of day when the time will be completed. When the time is completed the block is removed from the timer queue and placed on the message delivery queue as a message. Thus, all responsibilities placed on the state machine are accomplished in the operating system by transferring software messages and by the use of real-time flags and queues (semaphores).

Figure 10:
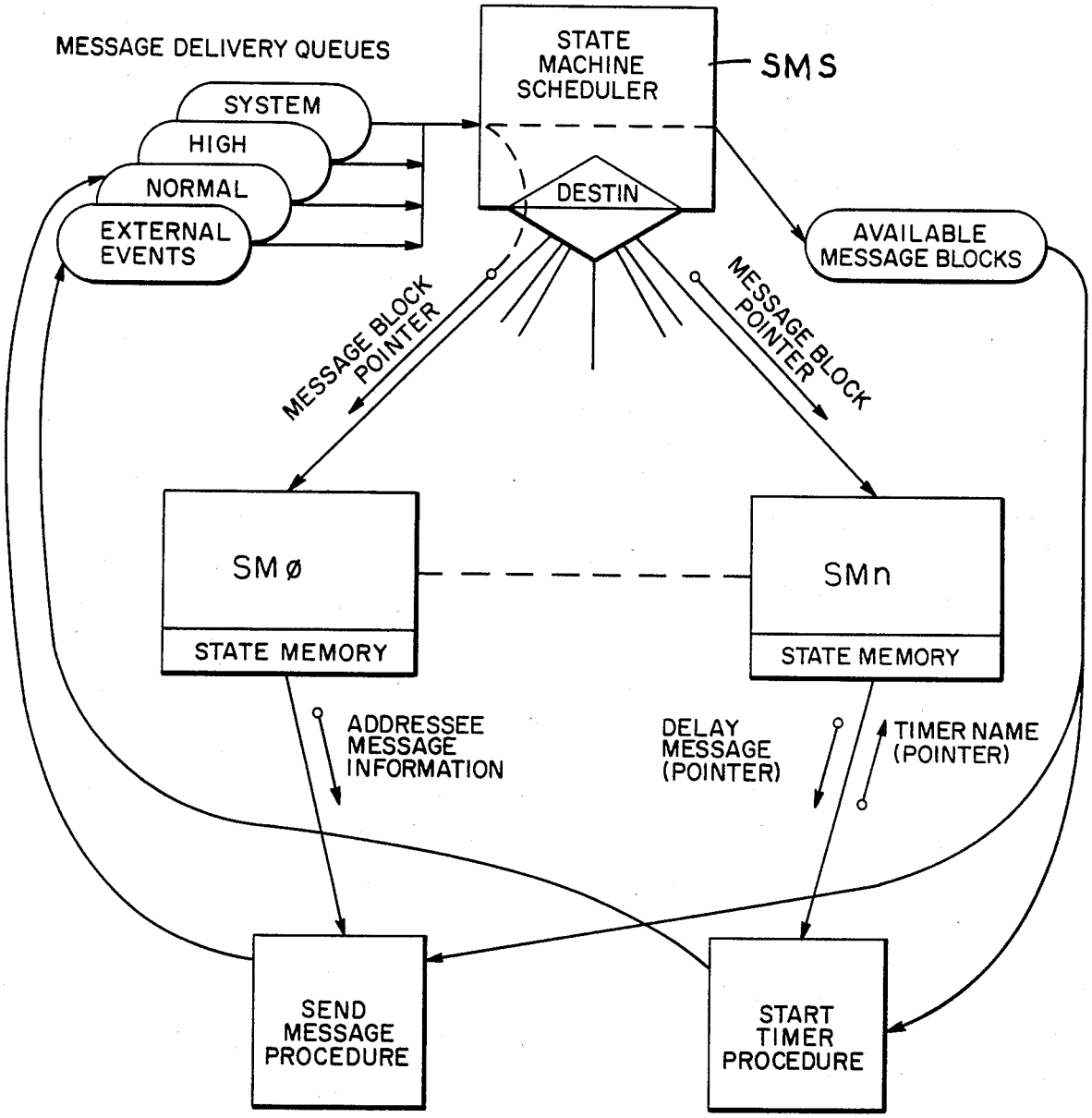
FIG. 10 illustrates a software state machine scheduler of the present invention.

The first component of the operating system (FIG. 9) is a program to deliver a message to a state machine (FIGS. 9, 10). A message is a small block of dynamic memory that is queued for delivery to a designated state machine. This program is called a state machine scheduler and shown in detail in FIG. 10 selects the next highest priority message from the queues of messages ready for delivery. The machine looks up the designation state machine code stored in the message and uses that code to select the proper state machine program to be called with a pointer to the message block as an input. Contained in the program is a state memory. With the memory and the state the proper process can be delivered and executed, and the memory block transferred from the delivery queue to the available space queue for subsequent reuse. Two examples of data that is reused are instructions for sending the messages or setting timers. These processes take available blocks and turn them into messages that will be on the message delivery queue at some later time. Programs such as the message sender and the timer starter are service utilities called by the state machine in order to fulfill the responsibilities alluded to earlier. The state machine scheduler program is the lowest form of the hierarchy which forms the main duty cycle of the operating system. In the diagram of FIG. 9 the relationship of the scheduler to the rest of the operating system is shown.

When power is turned on in the computer of FIGS. 6A, 6B, the power on reset generators **82*a*, 82*b* provides signals which reset various hardware in the computer and cause the first instruction of the computer program stored in the PROm 86*b* to be executed by the central processor 73*b*. A "power on" message is sent to each of the state machine modules 91–94 (FIG. 5) in the computer and these state machine modules are initialized. The signals from the plotter pen and beam position are obtained by the processor 73*b* through multiplexer 89*b* and converter 48*b* and stored in the RAM 87*b* (FIGS. 6B, 11) for use by the beam and pen analog-to-digital handler 93 (FIG. 5) which uses these signals to detect movement of the beam and/or pen and to display their values as a percentage of full scale. The power on messages cause each of the state machines 91–94 to enter their wait (1**) state.

The machines 91–94 interact in such a way as to permit more than one entry method for certain keyboard functions selected by the operator. In particular, the aforementioned control points (in this embodiment, load set point and stroke set point) are permitted to be entered either numerically from the keyboard 60 (FIG. 6B) or by means of operator movement of the plotter beam 62 (FIG. 4) or pen holder 63 (as selected) to a desired position on a previously plotted dynagraph. Actual entry of the value is by means of an enter key on the keyboard 60. The machines 91–94 operate in such a way as to determine which of the two possiblle entry methods occurred first, then enable this means and disable the other means.

The present method and apparatus provides a human operator with the flexibility of choosing to enter selected dynagraph parameters either graphically or through the numeric keyboard 60 (FIG. 6B) and relies on using the retransmitted signals from the XY recorder for information on the beam and pen holder positions. The primary method of entering the selected dynagraph parameters is by using the beam and pen holder position signals, while the keyboard is used as a backup to allow parameter selection in the event of a failure in the primary mode or to conveniently enter relatively small changes in the parameters.

The setup display handler 91 (FIGS. 5, 12) is responsible for display of information on the keyboard and display unit 60 (FIG. 6B) and for any applicable modification of well setup and display values. Well setup values may include stroke set point and load set point. Values out of the acceptable range are displayed with an error code to alert the human operator.

A "clear" message is sent to the setup display handler (FIG. 12) to clear any display/setup functions and to enable all function keys on the keyboard 60 (FIG. 6B). The machine waits for a keyboard input in the "key wait" state (2). When a switched message is received (at C, FIG. 12) indicating that a function key has been operated on the keyboard 60, it is determined whether the function can be entered by means of:

(A) Keyboard only, or (B) Keyboard or beam and pen movement.

A KBDORA2DINPUT message is sent to the parameter input selector 92 (FIG. 5) when both the keyboard and the beam and pen position are allowed as the input devices for a new parameter. Such is the case for load and stroke set point entry. A KBDINPUT is sent to the parameter input selector 92 (FIG. 5) when only a keyboard input is allowed. A "request old value" is sent (at C, FIG. 12) to the controller 71 via the serial communication line 66, 67 (FIG. 6A, 6B). The controller returns an "old value" message (at D, FIG. 12) along with the old value for that particular function. This value is then displayed on the display device **83*b* (FIG. 6B) so that the operator can see the current setting for the function he has selected. The setup display handler then enters the parameter wait state (at 4, FIG. 12**) to wait for a new value either from the keyboard handler or the A to D handler.

Figure 12:
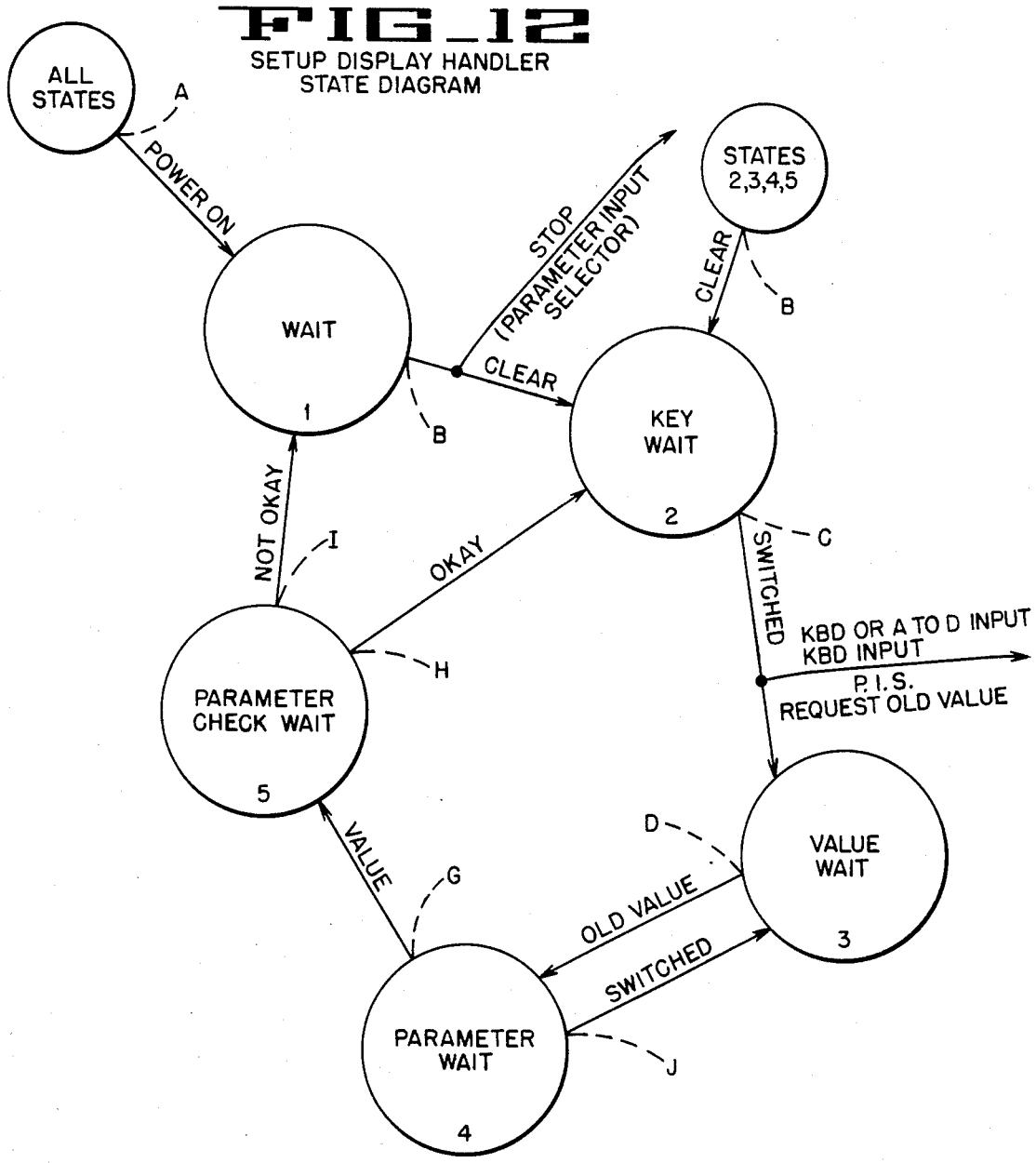
FIG. 12 is a state diagram for a setup display handler of the present invention.
Figure 13:
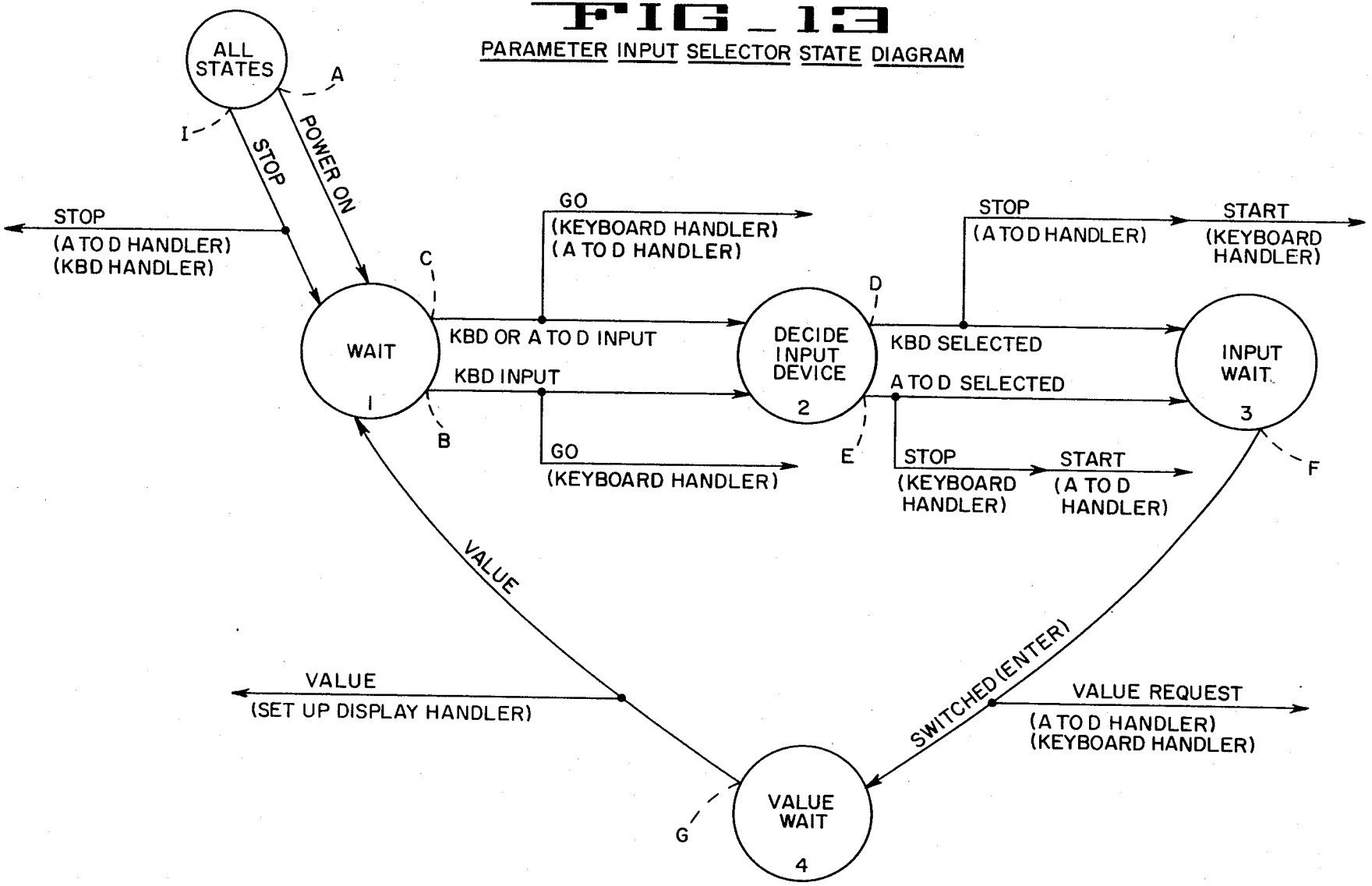
FIG. 13 is a state diagram for a parameter input selector of the present invention.
Figure 14:
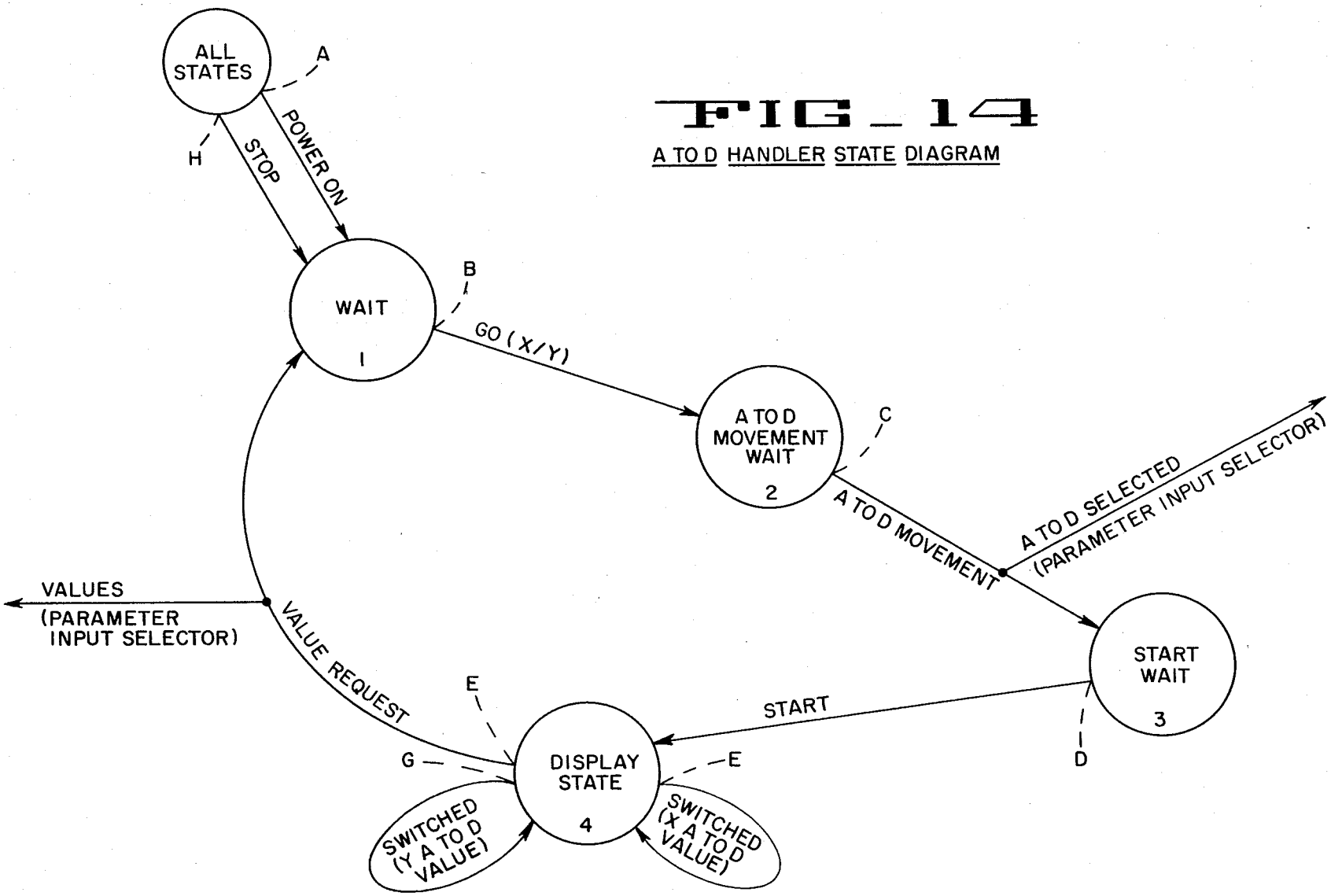
FIG. 14 is a state diagram of an analog to digital handler for use with an XY plotter of the present invention.
Figure 15:
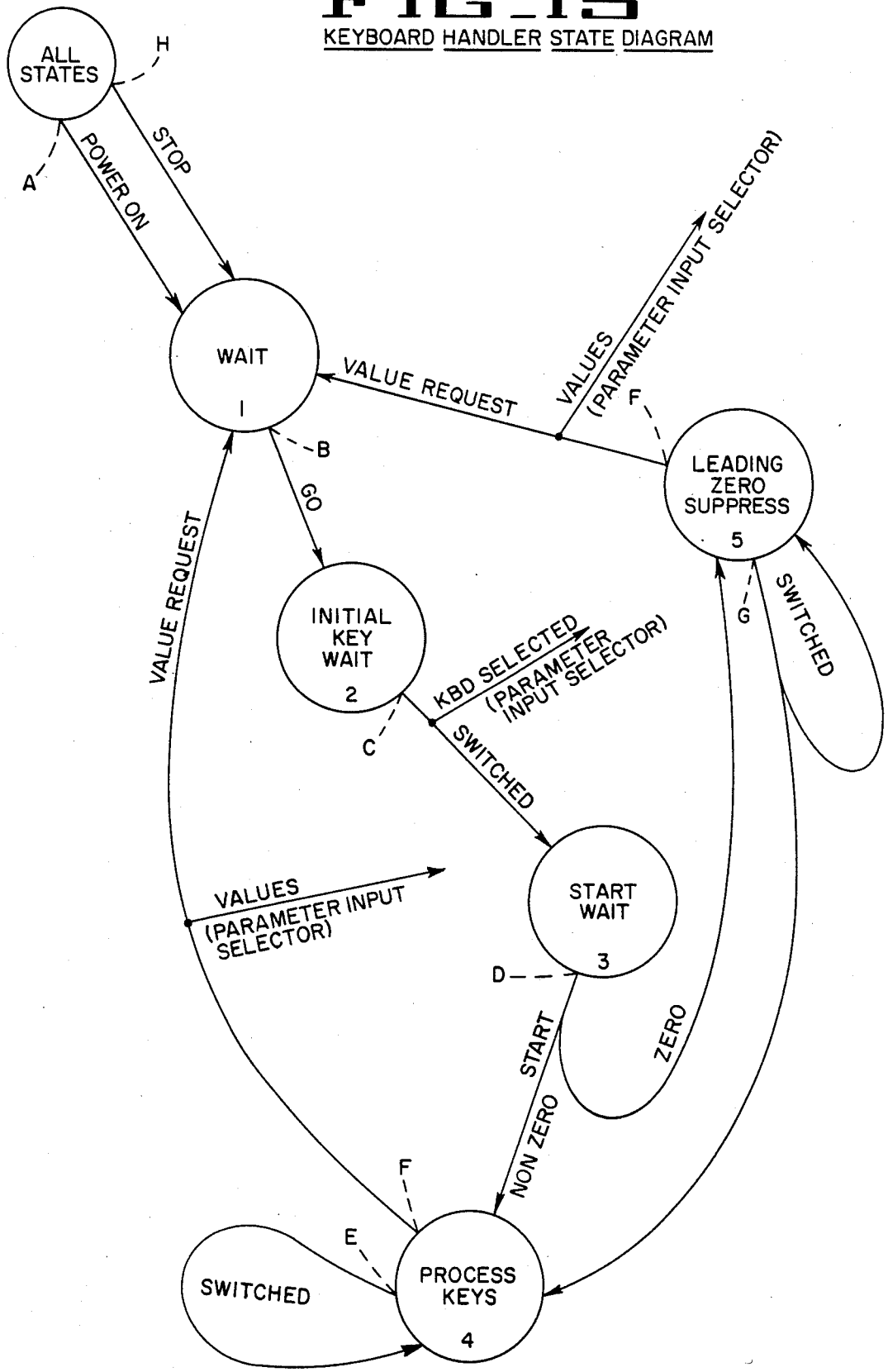
FIG. 15 is a state diagram of a keyboard handler of the present invention.

The parameter input selector 92 (FIGS. 5, 13) is responsible for:

(1) Enabling or disabling the possible parameter input device as requested by the setup display handler of FIG. 12.

(2) Receiving entered data and passing it to the setup display handler for range checking.

A KBDORA2DINPUT message from the setup display handler (FIG. 12) enables receiving of data from the A/D handler 93 (FIG. 5) or from the keyboard handler 94 (FIG. 5). Whichever of these devices is selected first becomes the input device. The KBDINPUT message (at B, FIG. 13) allows only values from the keyboard to be entered.

When a "KBD or A to D input" message is received (at C, FIG. 13) a "GO" message is sent to both the keyboard handler 94 (FIG. 5) and to the A to D handler 93. When a "KBD input" message is received (at B, FIG. 13), a "GO" message is sent to only the keyboard handler. The parameter input selector 92 (FIG. 5) then enters the decide input device state (FIGS. 2, 13) to await the response from either the keyboard or the A to D (beam and pen) handler 93. If keyboard entry occurs first, the parameter input selector 92 receives a "KBD selected" message (at D, FIG. 13). In this case a "stop" message is sent to the A to D handler 93 disabling entry from the beam and pen. At this time a "start" message is also sent to the keyboard handler, enabling it to display the values being input. If, however, the beam or pen entry occurs first, then the parameter input selector 92 will receive an "A to D selected" message (at E, FIG. 13) from the A to D handler 93. In this case a "stop" message is sent to the keyboard handler 94 disabling entry from the keyboard. At this time also a "start" message is also sent to the A to D handler enabling it to display the values being input by the pen and/or the beam.

When the human operator has entered the value he wants to put into the system he operates an enter switch (not shown) on the keyboard 60 (FIGS. 1, 6B). This causes a "switched" message to be sent to the parameter input selector 92 (at F, FIG. 13). At this time a "value request" message is sent to both the keyboard handler 94 and to the A to D (beam and pen) handler 93. The inactive device will not respond but the active device will return a "value" message to the parameter input selector 92 along with the entered value. When this "value" message is received by the setup display handler (at G, FIG. 12), the value is sent to the controller 72 (FIG. 6B) using the same methods previously described. If the value is acceptable to the controller the controller will return an "okay" message to the setup display handler 91 (FIG. 5). The setup display handler (at H, FIG. 12) will then clear the display and move to the keyboard wait state (2) to await the operation of another function key.

If, however, the value is not acceptable to the controller, the controller will return a "not okay" message to the setup display handler. The setup display handler (at I, FIG. 12) will then display an error code and move to the wait state (1). In this case a "clear" message must be received before function keys can be monitored again.

The A to D (beam and pen) handler 93 (FIGS. 5, 14) is responsible for reporting movement of the selected A to D device. When this machine receives a "GO" message from the parameter input selector 92 (at B, FIG. 14), it starts to monitor for movement of the selected device in the A to D movement wait state (2). When movement is detected (at C, FIG. 14) an "A to D selected" message is sent to the parameter input selector and the A to D handler enters the start wait state (3, FIG. 14). When a "start" message is received from the parameter input selector (at D, FIG. 14) as discussed earlier, the display state is entered. In the display state the beam and/or pen values are received on a regular timed basis and are displayed to the human operator on display **83*b***.

When the human operator operates the enter key on the keyboard 60 (FIGS. 1, 6B), causing a "value request" message (at G, FIG. 14) to be sent to the A to D handler as previously described, the display is frozen at the most recent value received and this recent value is sent to the parameter input selector as a "values" message as previously described. The A to D handler 93 (Fig. 5) then moves to the wait state (at 1, FIG. 14) where it can be activated again by another "GO" message. If, while the A to D handler is awaiting beam and/or pen movement, it receives a "stop" message (at H, FIG. 14) it then enters the wait state (1) and becomes inactive.

The keyboard handler 94 (FIGS. 5, 15) operates in a manner similar to the A to D handler except that it collects values for a given function entered via the keyboard 60 (FIG. 1) rather than the values entered by the plotter beam or pen position. The keyboard handler is responsible for reporting operation of one of the numeric keys (0–9) on the keyboard 60. When the keyboard handler receives a "GO" message from the parameter input selector 92 (at B, FIG. 15) it starts to monitor the keyboard for the operation of a numeric key. When the first such operation is detected, as indicated by a "switched" message (at C, FIG. 15), a "KBD selected" message is sent to the parameter input selector and the start wait state (3, FIG. 15) is entered.

When the "start" message is received from the parameter input selector (at D, FIG. 15) indicating that the keyboard entry method was first selected, either the process key state (4) or the leading zero suppression state (5) is entered depending upon whether the numeric entry is a zero or a nonzero value. The entered numbers are displayed on the display as they are entered with leading zeros being suppressed.

When the human operator operates the enter key on the keyboard 60 (FIGS. 1, 6B) causing a "value request" message to be sent to the keyboard handler (at F, FIG. 15) as noted before, the display is frozen at the value entered and the value is sent to the parameter input selector 92 (FIG. 5) as a "values" message. The keyboard handler then moves to its wait state (1) where it can be activated again by another "GO" message. If, while the keyboard handler machine is waiting for the first key to be pushed, it receives a "stop" message (at H, FIG. 15), it also enters the wait state (1) thus becoming inactive.

Although the best mode contemplated for carrying out the present invention has been herein shown and described, it will be apparent that modification and variation may be made without departing from what is regarded to be the subject matter of the invention.

What is claimed is:

1. Apparatus for entering control points relative to a dynagraph of a well pumping unit having a deep well pump connected to a sucker-rod string, a power unit to reciprocate said rod string to produce fluid from an underground location and a computing means for monitoring rod string position and rod string load to analyze well conditions, said apparatus comprising:

first transducer means for generating a signal representative of a load on said rod string;

second transducer means for generating a signal representative of a position of said rod string;

an XY plotter for using said load signal and said position signal to develop a dynagraph of load versus position of said rod string, said plotter having a beam and a pen holder for moving a pen to visibly produce said dynagraph;

means for using a signal proportional to the position of said beam and a signal proportional to the position of said pen holder to select a control point relative to said dynagraph; and means for entering said selected control point into said computing means for causing said pumping unit to be shut down when said dynagraph reaches a predetermined relationship to said selected control point.

2. Apparatus for entering control points as defined in claim 1 wherein said means for using a position and for entering said control point includes means for physically moving said beam and said pen holder to a selected position and means for closing a switch to cause the coordinates of said selected position to be entered into said computing means.

3. Apparatus for entering control points as defined in claim 1 wherein said means for using a position and for entering said control point includes a keyboard for selecting the coordinates of said selected position and for entering said coordinates into said computing means.

* * * * *